US009249793B2

(12) United States Patent
Brackel

(10) Patent No.: US 9,249,793 B2
(45) Date of Patent: Feb. 2, 2016

(54) PUMP NOISE REDUCTION AND CANCELLATION

(75) Inventor: Hans-Uwe Brackel, Meine (DE)

(73) Assignee: Baker Hughes Incorporated, Houston, TX (US)

( * ) Notice: Subject to any disclaimer, the term of this patent is extended or adjusted under 35 U.S.C. 154(b) by 764 days.

(21) Appl. No.: 13/548,906

(22) Filed: Jul. 13, 2012

(65) Prior Publication Data

US 2014/0017092 A1 Jan. 16, 2014

(51) Int. Cl.

| | |
|---|---|
| ***G01V 3/00*** | (2006.01) |
| ***F04B 47/02*** | (2006.01) |
| ***F04B 49/06*** | (2006.01) |
| ***F04B 49/08*** | (2006.01) |

(52) U.S. Cl.

CPC ..... *F04B 47/02* (2013.01); *F04B 49/06* (2013.01); *F04B 49/08* (2013.01)

(58) Field of Classification Search

CPC ..... G01V 3/00; F04B 49/00; E21B 47/18; E21B 47/00; F02B 33/44

USPC ..... 324/337; 417/63; 367/85, 83; 340/853.2; 133/250.01; 60/605.2; 73/1.62

See application file for complete search history.

(56) References Cited

U.S. PATENT DOCUMENTS

| | | | | |
|---|---|---|---|---|
| 3,602,322 | A * | 8/1971 | Gorsuch | 175/48 |
| 4,284,943 | A * | 8/1981 | Rowe | 318/806 |
| 4,642,800 | A * | 2/1987 | Umeda | 367/85 |
| 5,146,433 | A * | 9/1992 | Kosmala et al. | 367/83 |
| 5,901,795 | A | 5/1999 | Tsao et al. | |
| 6,741,185 | B2 * | 5/2004 | Shi et al. | 340/853.2 |
| 7,250,873 | B2 | 7/2007 | Hahn et al. | |
| 7,577,528 | B2 | 8/2009 | Li et al. | |
| 7,830,749 | B2 | 11/2010 | Kyllingstad | |
| 7,940,192 | B2 | 5/2011 | Reckmann et al. | |
| 8,111,171 | B2 | 2/2012 | Clark | |
| 8,480,957 | B2 * | 7/2013 | Truex et al. | 422/69 |
| 2004/0090234 | A1 * | 5/2004 | Macune | 324/337 |
| 2004/0131926 | A1 * | 7/2004 | Jones | 429/64 |
| 2006/0098531 | A1 | 5/2006 | Gardner et al. | |
| 2007/0151321 | A1 * | 7/2007 | Ohmi et al. | 73/1.62 |
| 2007/0189119 | A1 | 8/2007 | Klotz et al. | |
| 2009/0302850 | A1 * | 12/2009 | Lopez et al. | 324/337 |
| 2010/0314169 | A1 | 12/2010 | Jarrot et al. | |
| 2011/0048700 | A1 * | 3/2011 | van Zuilekom et al. | 166/250.01 |
| 2011/0052423 | A1 * | 3/2011 | Gambier et al. | 417/63 |
| 2012/0026002 | A1 | 2/2012 | Vu et al. | |
| 2012/0117963 | A1 * | 5/2012 | Hepburn et al. | 60/605.2 |
| 2012/0272174 | A1 * | 10/2012 | Vogel et al. | 715/772 |

FOREIGN PATENT DOCUMENTS

WO 2012027633 A2 3/2012

OTHER PUBLICATIONS

Klotz, et al. "A New Mud Pulse Telemetry System for Enhanced MWD/LWD Applications". IADC/SPE 112683, Drilling Confernce hled in Orlando, Florida, Mar. 4-6, 2008. 5 pages.

* cited by examiner

*Primary Examiner* — Travis Hunnings
(74) *Attorney, Agent, or Firm* — Cantor Colburn LLP

(57) ABSTRACT

A method for transmitting data from a downhole component includes: measuring a borehole fluid pressure by a receiver at a selected sampling rate and estimating a pressure signal transmitted through the fluid based on the sampled fluid pressures; measuring, by at least one pump stroke sensor, operation of a pump configured to advance fluid through the borehole; identifying individual stroke events from the pump stroke sensor measurement; generating a digital pump stroke signal in response to detecting one or more stroke events, each pump stroke signal including a digital time value associated with each of one or more stroke events; and transmitting the pump stroke signal to the receiver.

20 Claims, 4 Drawing Sheets

Pump substraction filter, general program flow.

Detail of strobe processing.

Timeline showing strobes from fast pump (top) and slow pump (bottom).

PUMP NOISE REDUCTION AND CANCELLATION

BACKGROUND

Mud pulse telemetry (MPT) is used to transmit data from downhole instruments to the surface using drilling mud or other fluids in a borehole (e.g., the mud column) as a "communication channel". Controlled pressure variations are used to modulate signals on top of the static mud pressure, which is generated by surface mud pumps. Pressure waves travel up to the surface, weakened by attenuation and other effects, where they are detected by one or more pressure transducers. During transmission, the pressure signals can be significantly affected by many "noise" sources. Pressure transducers are typically positioned closer to the mud pumps than to the pressure signal generators (e.g., mud pulsers), resulting in significant noise from the mud pumps in the detected signals. To attenuate the effect of the individual contributions of each piston in a mud pump, dampeners are used to smooth the pressure. Despite the use of dampeners, some pressure signal artifacts of each pump can remain and distort the MPT pressure signals.

SUMMARY

An embodiment includes a method for transmitting data from a downhole component. The method includes: measuring a borehole fluid pressure by a receiver at a selected sampling rate and estimating a pressure signal transmitted through the fluid based on the sampled fluid pressures; measuring, by at least one pump stroke sensor, operation of a pump configured to advance fluid through the borehole; identifying individual stroke events from the pump stroke sensor measurement; generating a digital pump stroke signal in response to detecting one or more stroke events, each pump stroke signal including a digital time value associated with each of one or more stroke events; and transmitting the pump stroke signal to the receiver.

Another embodiment includes a telemetry system having: a transmitter disposed in a borehole in an earth formation, the transmitter configured to generate a pressure signal in a downhole fluid representing a communication from a downhole component; a receiver configured to measuring a borehole fluid pressure at a selected sampling rate and estimate the pressure signal transmitted through the fluid based on the sampled fluid pressures; a pump stroke sensor configured to measure operation of a pump configured to advance fluid through the borehole; and a processor configured to: identify individual stroke events from the pump stroke sensor measurement and generate a digital pump stroke signal in response to detecting one or more stroke events, the pump stroke signal including a digital time value associated with each of one or more stroke events; and transmit the pump stroke signal to the receiver.

BRIEF DESCRIPTION OF THE DRAWINGS

The subject matter which is regarded as the invention is particularly pointed out and distinctly claimed in the claims at the conclusion of the specification. The foregoing and other features and advantages of the invention are apparent from the following detailed description taken in conjunction with the accompanying drawings in which:

DETAILED DESCRIPTION

Disclosed are systems and methods for transmitting pump stroke information and using such information to remove or reduce the effects of pump noise on fluid telemetry operations. In one embodiment, pump stroke signals are received from one or more pump stroke sensors and used to identify the position in time and/or time scale of each signature associated with a pump cycle. Pump Noise Cancellation (PNC) processing may be performed to remove the signatures from received telemetry pressure signals. One or more pump stroke sensors include or communicate with a processor configured to sample pressure measurements and transmit pump stroke signals on an event basis, i.e., in response to detecting a pump stroke event. In one embodiment, the processor generates a digital pump stroke signal including a pump identification and an event time indication, which can be used in a PNC processing algorithm. One embodiment of a PNC algorithm uses one stroke sensor and/or signal per pump, irrespective of the number of pistons per pump. The pump stroke signals and telemetry signals from a transmitter are received by a signal processing unit, which can be, e.g., a (centralized) data acquisition system or part of a smart pressure transducer. The systems and methods described herein are applicable both central processing configurations as well as distributed configurations, such as a digital sensor network, and serve to minimize transmission and communication bandwidth between sensors or other components in a telemetry system.

Figure 1:
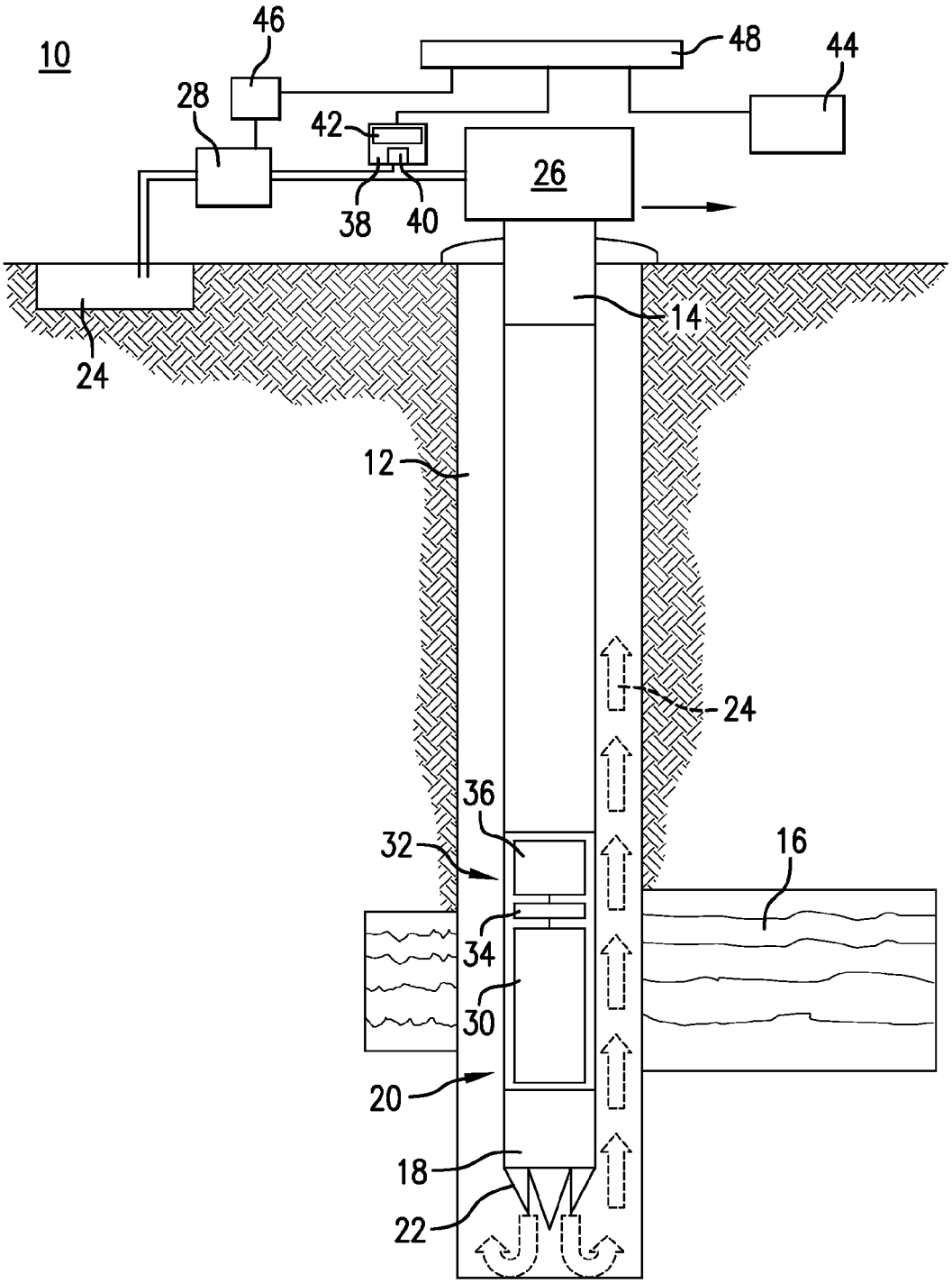
FIG. 1 depicts aspects of a drilling and/or measurement system 10.

Referring to FIG. 1, an exemplary embodiment of a downhole drilling, exploration, completion, production and/or measurement system 10 disposed in a borehole 12 is shown. A borehole string, shown in this embodiment as a drill string 14, is disposed in the borehole 12, which penetrates at least one earth formation 16. Although the borehole 12 is shown in FIG. 1 to be of constant diameter, the borehole is not so limited. For example, the borehole 12 may be of varying diameter and/or direction (e.g., azimuth and inclination). The drill string 14 is made from, for example, a pipe, multiple pipe sections or coiled tubing. The system 10 and/or the drill string 14 includes various downhole components or assemblies, such as a drilling assembly 18 (including, e.g., a drill bit and mud motor) and various measurement tools and communication assemblies, one or more of which may be configured as a bottomhole assembly (BHA) 20. The various measurement tools may be included for performing measurement regimes such as wireline measurement applications, logging-while-drilling (LWD) applications and measurement-while-drilling (MWD) applications.

In this embodiment, the drillstring 14 drives a drill bit 22 that penetrates the formation 16. Downhole drilling fluid 24, such as drilling mud, is pumped through a surface assembly 26 (including, e.g., a derrick, rotary table and standpipe) into the drillstring 14 using one or more pumps 28, and returns to the surface through the borehole 12. Although the embodiments described herein relate to drilling and LWD applications, they are not so limited. The embodiments may be incorporated with any system in which downhole fluid introduced, such as a production system in which fluid is pumped downhole to facilitate production of hydrocarbons from a formation and/or hydraulically stimulate or fracture a formation.

In one embodiment, a logging and/or measurement apparatus 30 including one or more sensors is disposed with the drill string 14, for example, as part of the BHA 20 and/or a measurement sub. Exemplary logging apparatuses include devices implementing resistivity, nuclear magnetic resonance, acoustic, seismic and other such technologies.

A telemetry system (e.g., a mud pulse telemetry (MPT) system) is included in the system 10 for transmitting signals between downhole components and/or between a downhole component and a surface component. The telemetry system can be used in conjunction with any suitable component, such as such as the drilling assembly 18 and/or the measurement apparatus 28, and is configured to transmit signals through the downhole fluid 24.

The telemetry system includes a transmitter 32 that is configured to generate a pressure signal such as a series of pulses or other pressure modulation in the fluid 24 representing communications and/or data from the downhole components. For example, the transmitter 32 includes an electronics package 34 that receives and/or generates data from the measurement apparatus 30, such as logging data (e.g., formation measurement data or drilling parameter data). A mud pulser 36 generates pulses representing this data, and the pulses propagate through the fluid 24 to the surface. The telemetry signal generated by the transmitter 32 can be pressure fluctuations in the base band such as positive or negative pressure "pulses" or modulations of the frequency and/or phase of the pressure signal. Examples of such signals include frequency shift key (FSK), phase shift key (PSK) and amplitude shift key (ASK) signals.

A receiver 38 includes one or more sensors, such as one or more pressure transducers 40, that detects the a pressure signal, i.e., telemetry signal induced pressure changes, and generates signals that can be analyzed by a suitable processor. The processor may be incorporated in the receiver 38, e.g., as a processor 42, or be part of a separate surface processing unit 44 that receives data from the receiver 38 through a wired or wireless connection.

In acquiring telemetry communications from the downhole component, a processor such as the surface processing unit 44 or the processor 42 receives signals from the pressure transducer 40 and various other sensors. For example, a pump stroke sensor 46 measures the timing and stroke rate of the pump(s) 28 and sends this information to the processor. Exemplary pulse sensors include inductive pulse sensors such as NAMUR sensors and mechanical breakers or relays.

For example, analog signals from the receiver 34 or pressure transducers 40 are routed through cabling into a dedicated acquisition device such as the surface processing unit 44, which samples and digitizes the signals. In another example, the signals from the pressure transducers are digitized in the receiver 38 and the digital signal is transmitted to the surface processing unit 44. The digital signals may optionally be filtered and further processed before they are further processed to perform noise cancellation. Finally, the filtered data stream is decoded to read the transmitted data or communication. The sampling, noise cancellation and decoding steps can be performed by separate processors, or can be performed using a single processor or processing unit.

In one embodiment, noise cancellation (or reduction) includes removing artifacts introduced by the pump(s) 28. These pressure signal artifacts of each pump can be recognized as "signatures," which are characteristic, finger-print like properties of each individual pump. Each pump cycle produces a recognizable pressure change pattern or signature that can be identified or calculated by, for example, filtering the pressure variations created by the pump(s). For example, as described further below the pump signatures can be calculated by identifying statistically significant noise and averaging the identified noise over multiple pump cycles.

In one embodiment, various components of the telemetry system are connected via a wired or wireless network. Exemplary wireless networks include a wireless local area network (LAN) and a wireless Highway Addressable Remote Transducer Protocol (WirelessHART) network. Various types of digital networks can be used, such as a bus network or an Ethernet, or combinations of network and bus systems.

One example of a bus network is shown in FIG. 1, which includes a field instrumentation bus 48 by which the various sensors communicate with one another and with processors. The bus 48 can be configured using any of various configurations or standards, such as Foundation Fieldbus, Profibus, Control Area Network (CAN) and others. The fieldbus endpoints (e.g. receivers 38, pump stroke sensors 46) are often located in areas which may possibly be exposed to explosive atmospheres ("hazardous area"). The instrument bus physical layer appropriate for this environment is "intrinsically safe" to avoid explosion hazards. Such physical layers for fieldbus systems are described in the IEC 61158-2 fieldbus standard.

In one embodiment, the receiver 38 is configured as a "smart" digital sensors, in which the actual acquisition of the telemetry signal and processing of the telemetry signal can be performed, including PNC processing. The receiver 38 includes a pressure sensor 40 connected to an A/D converter that is configured to sample the analog signal from the sensor at a selected rate, e.g., 1024 samples/second. Anti-aliasing and further noise reduction filtering can also be applied. In another embodiment, the receiver transmits the sampled digital signal (e.g., via the bus 48) to a dedicated acquisition device (DAQ) such as the surface processing unit 44. As the sensors are capable of A/D conversion, the sensor firmware could be expanded to also comprise decoding algorithms, which can further reduce bandwidth on communication bus channels.

Figure 2:
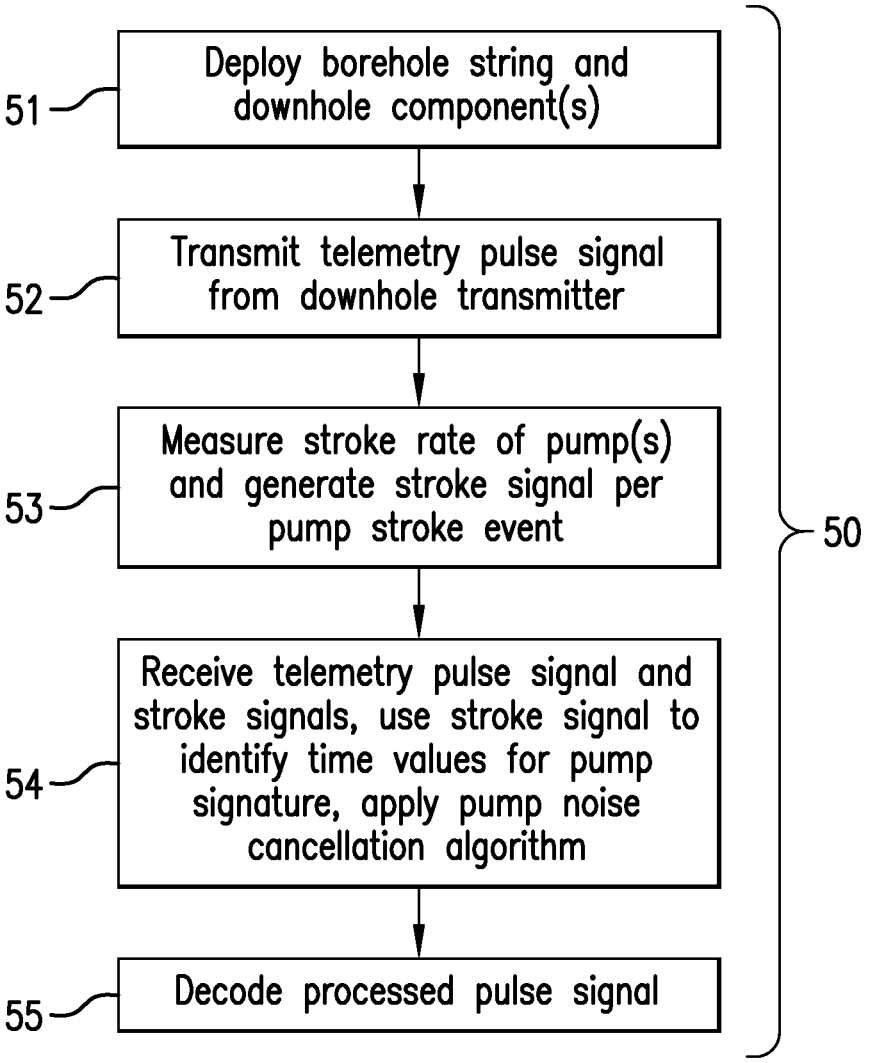
FIG. 2 is a flow chart of a method of communicating with or between downhole components and/or processing telemetry data.

FIG. 2 illustrates a method 50 of communicating with or between downhole components and/or processing communication data generated via intra-fluid telemetry, e.g., mud pulse telemetry. The method 50 includes one or more stages 51-55. Although the method 50 is described in some examples as being performed in conjunction with the system 10 and the mud pulse telemetry system described herein, the method 50 is not limited to use with these embodiments. In one embodiment, the method 50 includes the execution of all of stages 51-55 in the order described. However, certain stages may be omitted, stages may be added, or the order of the stages changed. In addition, a number of the stages can be performed concurrently or in parallel. For example, stages 52-55 may all be performed concurrently over the course of a downhole and/or telemetry operation.

In the first stage 51, a borehole string such as the drillstring 14 is disposed in the borehole, and a downhole operation is performed. Exemplary operations include drilling operations, LWD operations, wireline operations, completion operations, stimulation operations and others. Drilling mud or some other fluid 24 is circulated through the borehole 12 using one or more pumps 28.

In one embodiment, each component, e.g., the transmitter 32, the receiver 42 and the pump stroke sensor 46, includes clocks which are synchronized prior to deploying the drillstring 14 and/or prior to transmitting and receiving telemetry signals. All sensor internal sampling clocks are synchronized to an accuracy determined by the decoding and noise cancellation processing. For example, the maximum total jitter between 2 samples is approximately 200 μs, and thus the synchronization of clocks should be on the order of 10-50 μs.

In one embodiment, clock synchronization involves processing data received by one or more surface components (e.g. pressure transducer, pump stroke sensor, processing unit) into data (e.g., processable streams) that is associated with a timeline generated from timestamped events. For example, transmitter clock time values are shifted or otherwise modified based on the downhole tool clock drift.

It is noted that although only one transmitter 32, receiver 42 and pump stroke sensor 46 is shown, the method 50 is not limited to such a configuration. For example, the system 10 may have multiple transmitters 32 and/or receivers 42, or the system may include multiple pumps 28 and multiple associated pump stroke sensors 46.

In the second stage 52, the transmitter 32 generates a series of pulses via, for example, the mud pulser 36. A receiver 38 at a surface location (or alternatively at a remote downhole location) receives the series of pulses (i.e., the "pulse signal") via, for example, the pressure transducer(s) 40.

The receiver 38 transmits an analog or digital signal representing the pulse signal to a processor, such as the processor 42 or the surface processing unit 44. In one embodiment, the receiver 38 transmits the pulse signal as an analog signal to the processor, which samples and digitizes the pulse signal. In one embodiment, the receiver 38 transforms the signal (via, e.g., an analog-to-digital (A/D) converter in the receiver 38), and optionally transmits the resulting digital signal to another processor via, e.g., the field bus 42.

In one embodiment, the receiver 38 includes and/or is operably connected to an A/D converter that digitizes an analog signal produced by pressure transducers in the receiver. The A/D converter can be either a discrete component or can be integrated with the receiver 38, the processor 42 and/or the surface processing unit 44. If a processor such as the processor 42 is distinct from the receiver 38 or the A/D converter, the digitized signal can be transmitted to the processor via any suitable configuration, such as the instrumentation bus 48 (e.g., fieldbus).

In the third stage 53, a stroke sensor 46, e.g., an inductive proximity stroke sensor, measures stroke events generated by the pump 26. The stroke sensor 40 may include an A/D converter to sample the stroke sensor signal and convert it to a digital signal, or send an analog signal to another processor for sampling and conversion. For example, a digital pump stroke junction box can be used to connect a number of "n" pump stroke sensors.

Instead of sampling the stroke sensor 46 and generating a digital signal at the same sampling rate as the receiver (e.g., 1024 samples/second), the stroke sensor 46 generates and sends stroke information in an "event based" manner. In other words, the stroke sensor detects an "event" by detecting movement of various pump components (e.g., the piston) during a pump stroke and sends this information based on detecting the stroke event. In one embodiment, the stroke sensor 46 includes at least one proximity sensor. If the piston (or other pump component) passes by the stroke sensor 46, coming closer than the sensor's proximity sensitivity, the sensor 46 indicates this "proximity" by a binary signal change. Once the piston (or other component) moves away or passes the sensor, the sensor again indicates this by the opposite logical signal (e.g., 1, 0, high, low, current, no current, etc.) The movement can be, for example, a linear movement or a rotation.

For example, the stroke sensor measures an output signal (e.g., a current amplitude curve) and generates an on/off signal per time unit (some fraction of a second). For each time unit which an "on" signal (e.g., a logical "on" signal) is generated, i.e., a stroke event is detected, the sensor generates a stroke signal including the time of the event and, in one embodiment, a pump identifier (e.g., a pump number). For each pump stroke event, a stroke signal is generated and may be sent to the processor. In one embodiment, the stroke signal includes an identification of the pump if there are multiple pumps (e.g., a pump number) and a time value of the stroke event. A "stroke event" as described herein may include a full stroke, i.e., a full pump cycle, or may include a number of strobes or impulses that make up a full stroke.

In one embodiment, the sensor element itself within the stroke sensor can signal an event without further processing or sampling the stroke sensor signal. For example, the stroke sensor is configured to change polarity in response to movement or rotation of pump components. Indication of an event may then be triggered by the polarity change of the sensor signal, producing a time-based digital event signal.

In the case of the stroke sensor 46 including a proximity sensor, the proximity sensor may produce one or more impulses (also referred to as strobes) for each pump stroke. For example, if the proximity sensor is located near the center of the pump piston movement, the sensor may detect two impulses per pump stroke or crankshaft rotation. If the sensor is located near an end of the piston, the sensor may detect one impulse per pump stroke. Depending on the sensor's location, the movement of various components (e.g., the crankshaft, nuts or bolts) can cause additional impulses. A calibration factor associated with the number of impulses per pump stroke may thus be included in the stroke signal if necessary.

For example, a normalized pump stroke indicates exactly one crankshaft revolution. Pump speeds vary, but are usually in the order of 0-300 SPM (strokes per minutes), resulting in 0-5 stroke impulses per second for each pump. Based on synchronized sensor clocks, the stroke signal indicating the stroke event to be sent to the processor includes the pump number (or other type of pump identification) and the time of the event (stroke time). Stroke time can be an absolute time stamp or a relative time stamp (e.g. elapsed microseconds until power on or any other repeatable, high resolution time based tagging mechanism). If there are between one and five pumps per rig and a timestamp of 16 or 32 bits, the total required bandwidth for a stroke event is 3 bytes (1 byte for the pump number and 2 bytes for a 16-bit timestamp) or 5 bytes (1 byte for the pump number and 4 bytes for a 32-bit timestamp) per event. Thus, the total payload bandwidth per pump at a pump speed of 0-300 SPM (0-5 strokes/s) is less than or equal to 25 bytes/s. This is of course significantly less than a bandwidth of 1024 bytes/s or 1 kB/s if the pump stroke is sampled at the same rate as the sampling rate of the receiver 38.

A stroke signal can be sent individually for each stroke event, or multiple signals can be bundled and sent together. For example, the stroke sensor 46 or junction box can signal individual stroke events or, to further reduce the bandwidth, can send an array of stroke events every fixed number of seconds (or fractions thereof). This way multiple stroke events can be packaged into a single communication event, thereby further eliminating communication overhead.

In the fourth stage 54, the processor (e.g., the processor 42 or the surface processing unit 44) unit receives the telemetry pressure signal (e.g., mud pressure signal) as a digital signal (sampled at a selected sampling rate) or samples the analog signal at a selected sampling rate, and also receives stroke event signals from the stroke sensor 46. Each stroke event is applied to the telemetry pressure signal based on the time of the event provided by the stroke sensor, and is used to identify the time position and time interval for the pump signature (characteristic pressure variation) for each pump. The pump events are then used to analyze and/or process the telemetry pressure signal. For example, the pump events are used to reduce or eliminate via pump noise cancellation (PNC) algorithms.

Inside the receiving pressure sensor, the pressure signal may be buffered with acquisition time references dictating a maximum time period "$T_{buffer,max}$" for acquisition of each pressure signal (e.g. 5 seconds). When the stroke signal is received, the stroke event time is used to signal and relate the beginning of a crank shaft revolution. This information can be used as part of a suitable PNC cancellation algorithm for removal of signatures from one or more pumps from pressure signals measured by the receiver 38.

Although the "events" described above are described as pump strokes, impulses or strobes, they are not so limited. The events can be any recurring or identifiable change in a component (e.g., rotational or vibrational movement) that causes changes in pressure or flow during transmission of telemetry signals. Such events can introduce noise into the telemetry signal or introduce other (e.g., desirable) effects on the telemetry signal. In addition, the events need not be recurring or be considered noise. Measurement of such events facilitates identification of the "signature" (mark or effect) on the telemetry signal. The methods described herein can be used to identify and transmit information relating to any pressure event that is to be monitored.

Upon receiving pulse signals and event information, to reduce the mud pumps' distortion of the mud pulse signal due to their signatures, the processor may perform a PNC method or algorithm to subtracting the accumulated signatures of all pumps from the pulse signal. This effectively and efficiently reduces the "noise" of the pressure signal and helps to successfully decode the telemetry information.

In the fifth stage 55, the pressure signal (from which pump signatures have been removed) is decoded to read the data transmitted by the transmitter 32.

Figure 3:
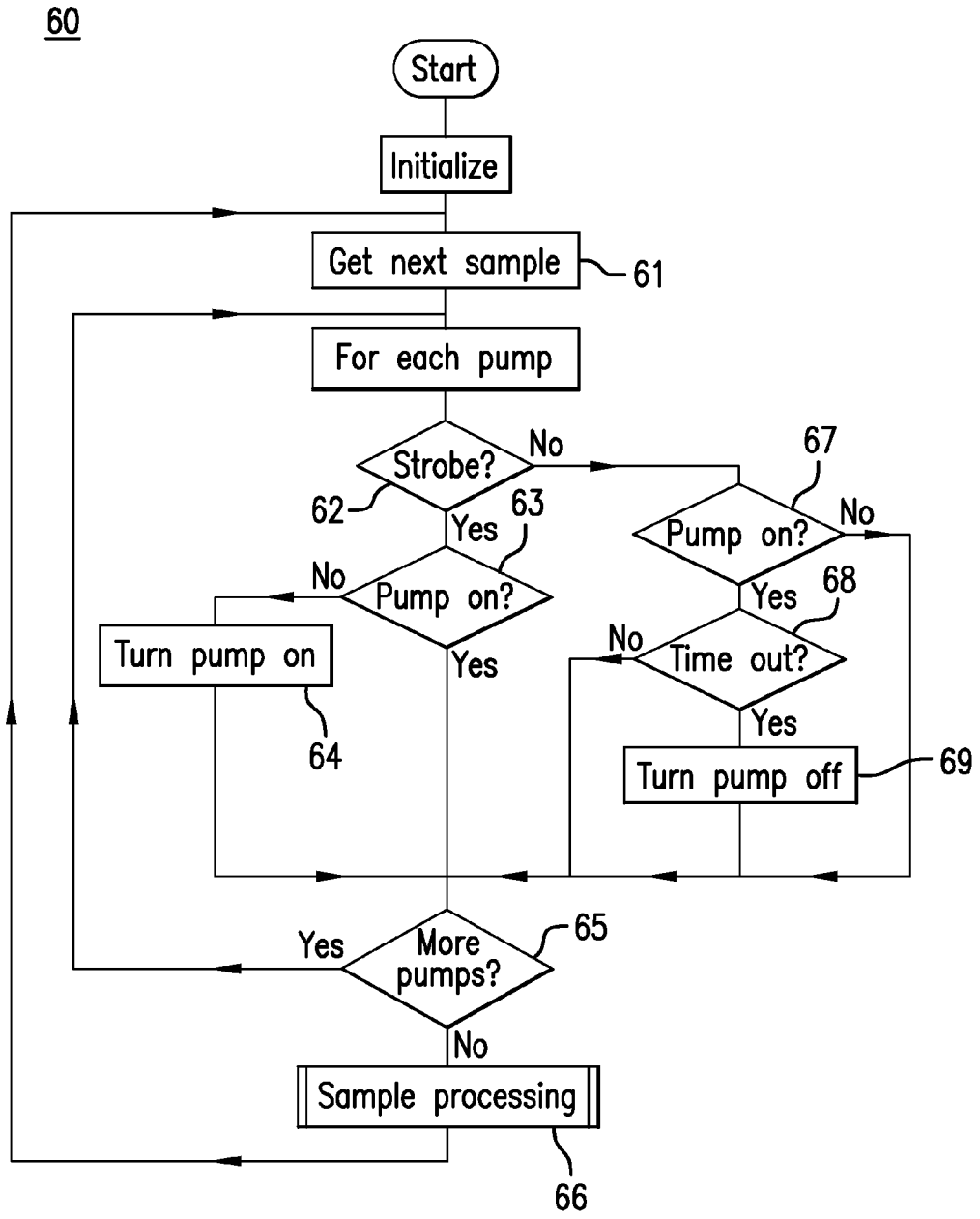
FIG. 3 depicts aspects of a pump noise cancellation method.
Figure 4:
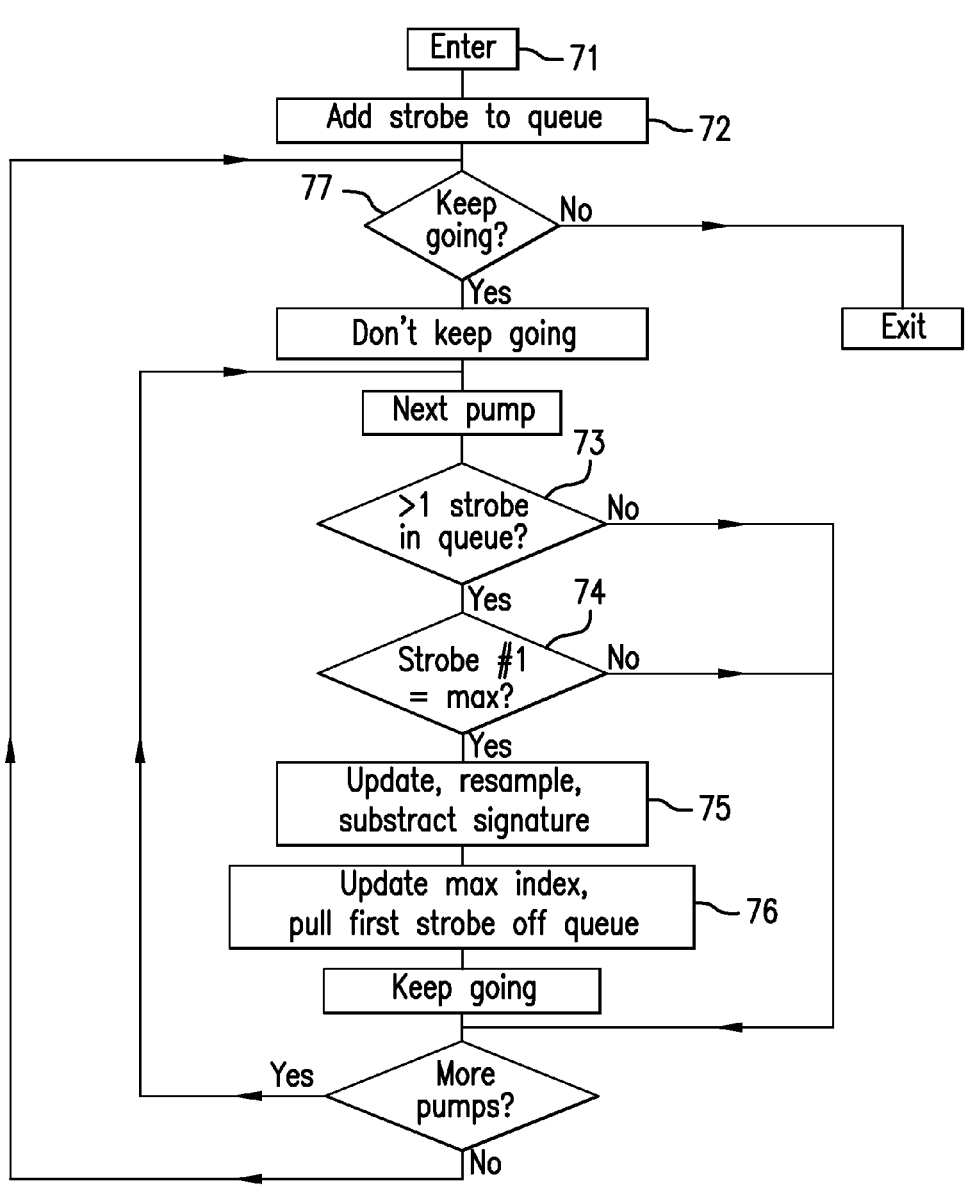
FIG. 4 depicts aspects of a pump noise cancellation method.
Figure 5:
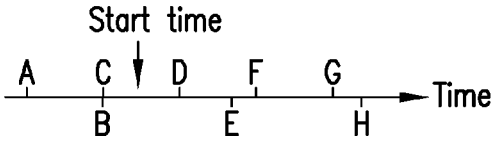
FIG. 5 is a timeline depicting exemplary stroke times for a plurality of fluid pumps.

An example of a PNC algorithm is described in conjunction with FIGS. 3-5. A "pump subtraction filter" is used to remove artifacts from pressure signals caused by mud pumps from pulse signal data. This is done by identifying and subtracting from the signal any components which recur at the same rate as the pump's crankshaft rotation. The algorithm removes from the pulse signal data any pump-derived components, whether they are traveling downward from the pump or reflected back upstream towards the pump. The algorithm is further described in U.S. Pat. No. 4,642,800, issued Feb. 10, 1987, the entirety of which is hereby incorporated by reference.

The algorithm uses inputs from telemetry receivers such as the receiver 38, as well as pump stroke information received from the stroke sensor 46. In one embodiment, the pump stroke information includes a number of pump stroke signals, each signal including a pump identifier (if necessary) and a time value of each pump stroke event (referred to herein as a "strobe") per pump stroke. If multiple strobes are indicated, the pump stroke signal may include a calibration factor.

In the example described herein, the pump strobe is derived from the stroke sensor 46 including a proximity switch attached to the mud pump, which senses a piston position and produces a signal once per crankshaft revolution. One pump strobe input is provided to the algorithm for each pump which might be feeding a borehole.

In this example, the inputs are received via an input data channel, which may be a pressure channel, or a flow meter output, or a combination of the two such as the output from an inference process. The algorithm may be used for a single pump and/or data channel, or may be used for any number of pumps and data channels (e.g., 1-4 data channels and 1-4 active pumps).

Output data is delivered via output channels, which typically correspond to the input data channels. In one embodiment, output data becomes available in bursts, typically around one second in length, because processing does not proceed until a pump strobe is received. It is also useful for the current state of each pump signature (one signature per pump) to be made available as output. This gives insight into the condition of the pumps.

The algorithm operates by maintaining a record of the signature of each pump. The signature corresponds to the pressure change measured associated with one pump stroke or crankshaft rotation, the time length of which can be measured using the time value of each strobe or stroke signal provided by the stroke sensor 46. The signature can be measured in the absence of telemetry signals to give an estimate of the pump contribution. In one embodiment, the pump signature is estimated by stacking or averaging a number of data sets, each data set being partitioned according to the stroke length. If multiple pumps are utilized, one signature per pump is maintained.

In order to remove the pump contribution from measured data, the signature of each active pump is subtracted from the telemetry pulse signal measured by the receiver 38, leaving a residual. When signatures of all active pumps have been subtracted, the resulting clean residual provides the output from the filter.

In order to account for variations in pump speed, after the pump signature is removed from measured data over a time interval, the signature is resampled or otherwise modified to change the time length of the signature. The change in time length can be ascertained based on the time interval of the next stroke signal. For example, suppose that the filter is running at a sample rate of 1024 per second, and that there is one pump running at 120 rpm. One crankshaft revolution (and therefore one time interval) therefore occupies 512 samples, and the pump signature is 512 samples in length. If the pump speed were to be instantaneously changed to 128 rpm, the signature would then be 480 samples in length. Before subtracting the pump signature from the new time interval, the signature would be resampled from a length of 512 to 480 samples. In practice, changes in pump rate tend to be gradual, and the resampling usually involves a change in signature length of only one or two samples.

Referring to FIG. 3, in one embodiment, the algorithm includes a method 60 for categorizing received data samples (e.g., pressure measurements from the receiver) and determining when noise cancellation processing is appropriate.

The method 60 includes receiving a sample (block 61), and for each pump determining whether a strobe has been received within the sample time interval (block 62). If a strobe has been received, it is determined whether the pump is on (block 63). In a first instance, if a strobe was received and the pump is off, the pump is turned on (block 64). In a second instance, if a strobe was received and the pump is on, it is determined whether there are more pumps for which a strobe should be received (block 65). When a strobe is received for all pumps, sample processing (block 66) can be commenced to reduce or remove pump noise (as described, for example, in conjunction with FIGS. 4-5).

If no strobe has been received, it is determined whether the pump is on (block 67). In a third instance, if the pump is on and has not timed out (block 68), the algorithm stops until a strobe is received. In a fourth instance, if the pump has timed out, the pump is turned off (block 69). In a fifth instance, no strobe is detected and the pump is off.

If one or more pumps fall into the first, fourth or fifth instances, then some housekeeping and updating of pointers will be required. If all pumps fall into the third instance, then no additional processing is required for this sample. Detailed noise cancellation processing is generally required only when an active pump (a pump which is already on) has received a strobe, as in the second instance described above.

FIG. 5 illustrates an algorithm or method 70 for performing noise cancellation for data measured where multiple pumps are running at different speeds. Strobe processing is more complex relative to processing for a single pump, because when multiple pumps are running at different speeds it is necessary to wait for a clean residual before updating and subtracting signatures.

Strobes are held in a queue; in many cases there may be no more than two strobes in the queue, indicating the start and end of a crankshaft cycle. However, there is provision for a longer queue in case one pump runs much faster than another, in which case strobes from the faster pump must be held until the slow pump completes its crankshaft revolution and the strobes can be cleared. Strobe processing is performed when a pump has more than one strobe in its queue (i.e. at least enough to define the beginning and end of a pump cycle), and when the first strobe in its queue represents the maximum valid output, i.e. the time up to which residuals are clear. The method 70 is described in conjunction with FIG. 5, which is an exemplary time line showing strobe arrivals from a fast pump and a slow pump. Strobes A, C, D, F and G represent times of strobes for the fast pump, and strobes B, E and H represent times of strobes for the slow pump. These strobes are identified using the pump stroke signal(s) generated as described above. Each pump is also associated with a respective signature.

In the example shown in FIG. 5, the present time is between C and D. The fast pump signature has been subtracted from interval AC, and the slow pump signature has been subtracted from the interval ending at time B. The most recent strobe from the fast pump is C, and the most recent strobe from the slow pump is B. The maximum valid output is B, which is the earliest among the "most recent" strobes from the various pumps. The "maximum valid output" represents the time up to which the residual is clean, i.e., the portion of the pressure signal from which both the fast and slow pump signatures have been removed; in this example, the residual is clean up to time B.

When a strobe is received (block 71), the strobe is added to a queue for the associated pump (block 72). At time D, a strobe is received from the fast pump and added to the fast pump queue. Although now there is more than one strobe in the fast pump queue (block 73), there is not yet a clean residual up to time C, because the first strobe C is not a maximum valid output (block 74). Processing cannot yet continue because the fast pump signature (between C and D) cannot yet be updated using the previous residual.

When strobe E is received (block 71), the strobe E is added to the slow pump queue. The slow pump queue now includes at least two strobes B and E (block 73) and the first strobe B in its queue is at the maximum valid output time (block 74). Therefore, the slow pump signature ending at B is subtracted from the interval BE and data representing a clean residual between B and C is output (block 75). A "maximum-valid-output" pointer is then moved from B to C (block 76).

Because the output data has changes, a "keep-going" flag is set (block 77), and the strobe queues are checked to determine if further processing can be performed. In this example, processing can proceed because there is a clean residual on interval AC, so the fast pump signature is updated with a fraction of the residual on AC, and the updated signature is subtracted from the interval CD. Interval CD is output, and the maximum-valid-output pointer moves to D.

The processing continues for additional strobes until all of the measured data is processed to remove pump signatures. For example, strobe F is next received from the fast pump. The signature on CD is subtracted from interval D, the interval DE is output, and the max-valid-output pointer is moved to E. Strobe G is then received from the fast pump. This is added to the fast pump's queue, but nothing more can be done with the fast pump until there is a clean residual on DF.

Strobe H is received from the slow pump. The signature corresponding to BE is subtracted from EH, interval EF is output, and the max-valid-output pointer moves to F. The fast pump signature DF is then subtracted from interval FG, interval FG is output, and the max-valid-output pointer moves to F.

Additional exemplary features of the procedure 70 are described. In one embodiment, the process includes variable weighting. When a signature is updated, a fraction of the clean residual is added back into the signature. This could be a fixed fraction, such as, e.g., 1/20. However, if this were done, it would take more than 20 pump cycles for the signature to be developed when the pumps are started up. Ideally, the signature should be developed rapidly when the pump first starts up, then updated at a progressively slower rate to maintain stability. The algorithm can therefore update the signature using a fraction 1/n of the previous clean residual, where n starts out with an initial value (e.g., two) and increases by some amount (e.g., one) for each update, until it reaches a maximum value (e.g., 20).

In one embodiment, the procedure includes auto-scaling, in which, as the pump speed changes, its signature is properly resampled in time. For example, when the signature is updated, if the latest strobe interval has increased or decreased, the signature is correspondingly expanded or compressed using, e.g., linear interpolation. In one embodiment, as the pump goes slower, it produces smaller pressure surges because the rate of change of flow is smaller. The algorithm can therefore adjust the amplitude of the signature each time it has to be resampled; the amplitude is inversely proportional to the signature length.

In one embodiment, the procedure includes signature mean subtraction. The pump signature represents the transient component of the measured data which is attributable to acceleration of the pump pistons. It is not intended to include a DC component. Each time a signature is resampled, just before it is subtracted from the data, it is adjusted to have a zero mean. The result is that any DC component in the original data is passed through to the output, where it may be used to determine a pumps-on condition.

In one embodiment, signature slope subtraction is performed. The signature is a recurring data series, which should start and end at the same point. However, when the input data is ramping up or down with a significant slope, the signature may be computed with a slope. This is undesirable, because if such a sloping signature is subtracted from the input data, it produces a "stair-step" character in the output. The algorithm may therefore remove any slope or trend in the signatures before they are subtracted.

In one embodiment, the procedure incorporates timeout processing. The algorithm is able to accommodate changes in pump speed. However, when a pump speed becomes very slow, it is not reasonable to expect the algorithm to hang indefinitely while waiting for a strobe. The algorithm therefore applies a timeout period (e.g., 5 seconds); if a strobe has not arrived from a particular pump within the timeout period, that pump is assumed to be turned off.

The systems and methods described herein provide various advantages over prior art techniques. For example, pump stroke signals may be transmitted and processed using a lower bandwidth relative to prior art techniques.

In typical MWD telemetry systems, pressure signals are sampled at a rate of 1024 samples/s. For calculating the mud pump pressure signatures, the pump stroke sensors are synchronously sampled at the same frequency/time resolution as the pressure sensors. The pressure signals and pump stroke signals are collected by a DAQ (Data Acquisition Box) containing the processing engine. These signals require that individual segments of the telemetry network (e.g., fieldbus segments) have a high bandwidth, requiring extra effort to realize the system and reducing the versatility of the system. The systems and method described herein address these deficiencies. Furthermore, due to the relatively low bandwidth of the decoded telemetry signals described herein, dedicated acquisition boxes (which are expensive and bulky due to their isolation barriers) can be avoided, and even full wireless systems can be built, further reducing installation effort and equipment cost.

In support of the teachings herein, various analysis components may be used, including digital and/or analog systems. The digital and/or analog systems may be included, for example, in the receiver 38, the stroke sensor 46 and/or the surface processing unit 44. The systems may include components such as a processor, analog to digital converter, digital to analog converter, storage media, memory, input, output, communications link (wired, wireless, pulsed mud, optical or other), user interfaces, software programs, signal processors (digital or analog) and other such components (such as resistors, capacitors, inductors and others) to provide for operation and analyses of the apparatus and methods disclosed herein in any of several manners well-appreciated in the art. It is considered that these teachings may be, but need not be, implemented in conjunction with a set of computer executable instructions stored on a computer readable medium, including memory (ROMs, RAMS, USB flash drives, removable storage devices), optical (CD-ROMs), or magnetic (disks, hard drives), or any other type that when executed causes a computer to implement the method of the present invention. These instructions may provide for equipment operation, control, data collection and analysis and other functions deemed relevant by a system designer, owner, user or other such personnel, in addition to the functions described in this disclosure.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for transmitting data from a downhole component, the method comprising:

receiving a fluid pulse telemetry signal at a receiver, wherein receiving includes measuring a borehole fluid pressure by the receiver at a selected sampling rate and estimating the telemetry signal transmitted through the fluid based on the sampled fluid pressures;

measuring, by at least one pump stroke sensor, operation of a pump configured to advance at least a portion of the borehole fluid through the borehole, wherein measuring includes detecting one or more individual events related to movement of one or more components of the pump;

generating a digital pump stroke signal for each of the one or more individual events, each digital pump stroke signal including a digital time value associated with one of the one or more individual events; and transmitting the telemetry signal and each digital pump stroke signal to a signal processing unit, the signal processing unit configured to remove a pump signature from the telemetry signal.

2. The method of claim 1, wherein generating the digital pump stroke signal includes generating an individual digital signal for each of a plurality of individual stroke events and storing a plurality of individual digital pump stroke signals, and transmitting includes transmitting an array of the plurality of individual digital signals to the signal processing unit as a signal transmission.

3. The method of claim 1, wherein generating the digital pump stroke signal includes sampling the pump stroke sensor measurement at a sampling rate that is less than the selected sampling rate of the receiver.

4. The method of claim 1, wherein generating the digital pump stroke signal includes triggering an event signal associated with each individual event based on a time-based change in the pump stroke sensor measurement.

5. The method of claim 4, wherein the time-based change is a polarity change in the pump stroke sensor measurement.

6. The method of claim 1, wherein the stroke event is at least one of a full pump cycle and one or more strobes.

7. The method of claim 1, wherein the pump stroke signal includes a calibration factor relating to a number of strobes associated with the full pump cycle.

8. The method of claim 1, wherein the digital pump stroke signal includes only the time value and an identifier that identifies the pump stroke sensor.

9. The method of claim 1, wherein transmitting the pump stroke signal includes sending one pump stroke signal for each of the one or more stroke events, each pump stroke signal having only a digital indication of the time value of the stroke event and a pump identification.

10. The method of claim 1, wherein generating the digital pump stroke signal includes sampling the pump stroke sensor measurement at the selected sampling rate, and disregarding data from the sampled pump stroke signal that does not indicate a stroke event.

11. The method of claim 1, further comprising removing pump artifacts from the pressure signal using the pump stroke signal.

12. The method of claim 11, wherein removing pump artifacts includes applying the pump signature to the pressure signal, the pump signature representing a pressure variation due to the pump during a full pump cycle.

13. The method of claim 12, wherein removing pump artifacts includes subtracting the pump signature from the pressure signal over a time interval calculated based on the pump stroke signal.

14. A telemetry system comprising:

a transmitter disposed in a borehole in an earth formation, the transmitter configured to generate a pressure signal in a borehole fluid representing a communication from a downhole component;

a receiver configured to measure a borehole fluid pressure at a selected sampling rate and estimate the pressure signal transmitted through the fluid based on the sampled fluid pressures;

a pump stroke sensor configured to measure operation of a pump configured to advance at least a portion of the borehole fluid through the borehole, wherein measuring includes detecting one or more individual events related to movement of one or more components of the pump;

a processor configured to:

generate a digital pump stroke signal for each of the one or more individual events, each digital pump stroke signal including a digital time value associated with one of the one or more individual events; and transmit the pressure signal and each digital pump stroke signal to a signal processing unit, the signal processing unit configured to remove a pump signature from the telemetry signal.

15. The system of claim 14, wherein each digital pump stroke signal includes a pump identification.

16. The system of claim 14, wherein the processor is configured to send one digital pump stroke signal for each of the one or more individual events, each pump stroke signal having only a digital indication of the time value of the stroke event and a pump identification.

17. The system of claim 14, wherein the processor is configured to generate the digital pump stroke signal by sampling the pump stroke sensor measurement at the selected sampling rate, and disregarding data from the sampled pump stroke signal that does not indicate a stroke event.

18. The system of claim 14, wherein the processor is configured to remove pump artifacts from the pressure signal using the pump stroke signal.

19. The system of claim 14, wherein the processor is connected to the receiver by one of a wired network and a wireless network.

20. The system of claim 14, wherein the processor is connected to the receiver via a field instrumentation bus.

* * * * *